US009576714B2

(12) United States Patent
Cheng et al.

(10) Patent No.: US 9,576,714 B2
(45) Date of Patent: Feb. 21, 2017

(54) MAGNETIC ACTUATOR

(71) Applicant: Siemens Aktiengesellschaft, München (DE)

(72) Inventors: Jian Cheng, Beijing (CN); Ying Hua Song, Beijing (CN); Lan Jin Wang, Beijing (CN); Chao Yang, Beijing (CN); Ji Long Yao, Beijing (CN); Yan Feng Zhao, Beijing (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/784,445

(22) PCT Filed: Jul. 11, 2013

(86) PCT No.: PCT/CN2013/079236
§ 371 (c)(1),
(2) Date: Oct. 14, 2015

(87) PCT Pub. No.: WO2015/003370
PCT Pub. Date: Jan. 15, 2015

(65) Prior Publication Data

US 2016/0111238 A1 Apr. 21, 2016

(51) Int. Cl.
*H01F 7/16* (2006.01)
*H01H 3/22* (2006.01)
(Continued)

(52) U.S. Cl.
CPC ..... *H01F 7/1646* (2013.01); *H01F 7/081* (2013.01); *H01H 3/22* (2013.01); *H01H 3/28* (2013.01);
(Continued)

(58) Field of Classification Search
CPC ..... H01F 7/081; H01F 7/1646; H01H 3/22; H01H 50/64; H01H 50/18; H01H 50/42; H01H 3/28; H01H 2235/01
See application file for complete search history.

(56) References Cited

U.S. PATENT DOCUMENTS 3,070,730 A * 12/1962 Gray ..... H01F 7/1615 335/229
3,859,547 A * 1/1975 Massie ..... H01F 7/1615 310/14
(Continued)

FOREIGN PATENT DOCUMENTS

CN 2840291 Y 11/2006
CN 101315836 A 12/2008
(Continued)

OTHER PUBLICATIONS

International Search Report PCT/ISA/210 for International Application No. PCT/CN2014/079236 Dated Mar. 27, 2014.
(Continued)

*Primary Examiner* — Mohamad Musleh
(74) *Attorney, Agent, or Firm* — Harness, Dickey & Pierce, P.L.C.

(57) ABSTRACT

A magnetic actuator includes: a movable unit, movable between a first position and a second position, and including an integrally formed eddy-current component and first magnet yoke component; a second magnet yoke component to form a magnetic circuit with the first magnet yoke component; an electromagnetic coil capable of generating an exciting magnetic field when being energized, magnetic lines generated thereby being energized penetrating the magnetic circuit formed by the first and second magnet yoke components; an eddy-current coil to enable an eddy current to be generated in the eddy-current component, to produce an electromagnetic repulsive force to the movable unit; and
(Continued)

a permanent magnetic holding component to hold the movable unit in the first position or the second position. The magnetic actuator can simplify the actuator, reduce the number of components and the size thereof, as well as reducing the energy consumption and improving the stability thereof.

18 Claims, 4 Drawing Sheets

(51) Int. Cl.

| | |
|---|---|
| ***H01H 3/28*** | (2006.01) |
| ***H01F 7/08*** | (2006.01) |
| ***H01H 50/18*** | (2006.01) |
| ***H01H 50/42*** | (2006.01) |
| ***H01H 50/64*** | (2006.01) |

(52) U.S. Cl.
CPC ..... *H01H 50/18* (2013.01); *H01H 50/42* (2013.01); *H01H 50/64* (2013.01); *H01H 2235/01* (2013.01)

(56) References Cited

U.S. PATENT DOCUMENTS 4,253,493 A * 3/1981 English ..... F01L 9/04 137/625.18
4,272,661 A 6/1981 Dethlefsen
4,533,890 A * 8/1985 Patel ..... F01L 9/04 310/14
4,774,485 A * 9/1988 Dietrich ..... H01H 51/2209 335/230
4,883,025 A * 11/1989 Richeson, Jr. ..... F01L 1/16 123/90.11
4,928,028 A * 5/1990 Leibovich ..... H01F 7/1646 310/23
5,896,076 A * 4/1999 van Namen ..... H01F 7/1615 335/222
6,020,567 A * 2/2000 Ishikawa ..... H01H 3/28 218/120
6,166,896 A * 12/2000 Schmitz ..... F01L 9/04 361/155
6,334,413 B1 * 1/2002 Hattori ..... F01L 9/04 123/90.11
8,228,149 B2 * 7/2012 Puth ..... H01F 7/1615 335/220
2012/0169441 A1 * 7/2012 Kim ..... H01F 7/1615 335/179

FOREIGN PATENT DOCUMENTS

CN 102881493 A 1/2013
WO WO-2008/139250 A1 11/2008

OTHER PUBLICATIONS

Written Opinion of the International Searching Authority PCT/ISA/237 for International Application No. PCT/CN2014/079236 dated Mar. 27, 2014.

* cited by examiner

MAGNETIC ACTUATOR

PRIORITY STATEMENT

This application is the national phase under 35 U.S.C. §371 of PCT International Application No. PCT/CN2013/079236 which has an International filing date of Jul. 11, 2013, which designated the United States of America, the entire contents of which are hereby incorporated herein by reference.

TECHNICAL FIELD

The present invention generally relates to an actuator, and particularly to a magnetic actuator of a circuit breaker or a high-speed reversing switch.

BACKGROUND ART

Actuators are important components of the circuit breaker and the high-speed reversing switch. At present, there are spring actuators, electromagnetic actuators, and permanent magnetic actuators, etc. The spring actuators have the advantage that there is no need for a high-power direct-current power supply and have the defects of relatively complicated structure, more parts, and poor reliability. The electromagnetic actuators have a cumbersome structure and a relatively long switching-off and switching-on time.

The permanent magnetic actuators use a permanent magnet as a component for keeping the switching-off and switching-on positions. When the permanent magnetic actuators work, only one main moving component is provided, the switching-off and switching-on current is small, the mechanical service life is long, but the movement inertia of the moving component when in a switching-off state is relatively large, and a higher action speed cannot be achieved.

A typical actuator of a vacuum circuit breaker is disclosed in China patent CN 101315836 A (published on Feb. 13, 2008), the actuator mainly comprising an eddy-current disc, a switching-off coil, a switching-on coil and a charging circuit. When the charging circuit is excited, the rapidly-increased current would flow through the switching-off coil or the switching-on coil, and the switching-off coil or the switching-on coil will induce an eddy current in the eddy-current disc. In this way, a relatively large electromagnetic repulsive force can drive the eddy-current disc to leave the corresponding coil. The actuator further comprises a spring mechanism for keeping the switching-off state and the switching-on state. Although the switching-off operation can be rapidly realized by virtue of the electromagnetic repulsive force, the actuator has a large energy consumption and poor controllability.

SUMMARY

At least one embodiment of the present invention aims at simplifying the actuator, reducing the size thereof, reducing the energy consumption and improving the stability.

An embodiment of the present invention provides a magnetic actuator, comprising: a movable unit capable of moving between a first position and a second position, the movable unit comprising an eddy-current component and a first magnet yoke component, which are formed integrally; a second magnet yoke component for forming a magnetic circuit with the first magnet yoke component; an electromagnetic coil capable of generating an exciting magnetic field when being energized, with magnetic lines generated by the energized electromagnetic coil penetrating the magnetic circuit formed by the second magnet yoke component and the first magnet yoke component; an eddy-current coil arranged opposite to the eddy-current component and enabling an eddy current to be generated in the eddy-current component, so as to produce an electromagnetic repulsive force to the movable unit; and a permanent magnetic holding component for holding the movable unit in the first position or the second position.

Preferably, the first magnet yoke component is provided with a groove, and the eddy-current component is arranged in the groove.

Preferably, the eddy-current component and the first magnet yoke component together form a cone or a truncated cone.

Preferably, the electromagnetic coil and the eddy-current coil are both located in a framework formed by the eddy-current component and the first magnet yoke component.

Preferably, the electromagnetic coil and the eddy-current coil share one power supply or one power supply capacitor, or respectively utilize different power supplies or different power supply capacitors.

Preferably, the actuator is applied to a circuit breaker, the actuator further comprises a drive rod, the drive rod is connected to the movable unit, and one end of the drive rod is connected to a contact terminal of the circuit breaker.

Preferably, the other end of the drive rod is connected to a spring. The spring is used for holding the movable unit in one of either a switching-off position or a switching-on position of the circuit breaker, and the permanent magnetic holding component is used for holding the circuit breaker in the other of the switching-off and switching-on positions.

Preferably, two groups of actuators are symmetrically arranged relative to the drive rod.

According to the embodiment of the present invention, the eddy-current component and the first magnet yoke component are integrally designed, so that compared with the existing actuators, this actuator is small in size and compact in structure; meanwhile, this actuator has fewer components, so that the reliability thereof is better, and the control mode is more flexible. Due to the compact structure, a plurality of circuit breakers with such an actuator can be connected in series in a high-voltage application. For example, if the rated voltage of a circuit breaker with the actuator is 20 KV, and the rated voltage of a power transmission line is 50 KV, then three circuit breakers of this type can be connected in series to protect the power transmission line. In addition, in a preferable embodiment, the switching-on and switching-off operations can be realized by way of a combination of the electromagnetic coil and the eddy-current coil, such that the current value loaded on the eddy-current coil can be greatly reduced when the movable unit is separated from the second magnet yoke by a certain gap, and the energy consumption can be reduced.

BRIEF DESCRIPTION OF THE DRAWINGS

FIG. 4 shows one state of the circuit breaker, and FIG. 5 shows another state of the circuit breaker.

DETAILED DESCRIPTION OF EXAMPLE EMBODIMENTS

In order to make the technical solution and advantages of the present invention clearer, embodiments of the present invention are further illustrated in detail in conjunction with the attached drawings.

It should be understood that the particular embodiments described herein are only used for illustratively describing the present invention, and are not intended to limit the scope of protection of the present invention.

A magnetic actuator in the embodiment of the present invention comprises a movable unit capable of moving between a first position and a second position. The movable unit comprises an eddy-current component and a first magnet yoke component, which are formed integrally; a second magnet yoke component for forming a magnetic circuit with the first magnet yoke component; an electromagnetic coil capable of generating a magnetic field when being energized, with magnetic lines generated by the energized electromagnetic coil penetrating the magnetic circuit formed by the second magnet yoke component and the first magnet yoke component; an eddy-current coil arranged opposite to the eddy-current component and enabling an eddy current to be generated in the eddy-current component, so as to produce an electromagnetic repulsive force to the movable unit; and a permanent magnetic holding component for holding the movable unit in the first position or the second position.

Figure 1:
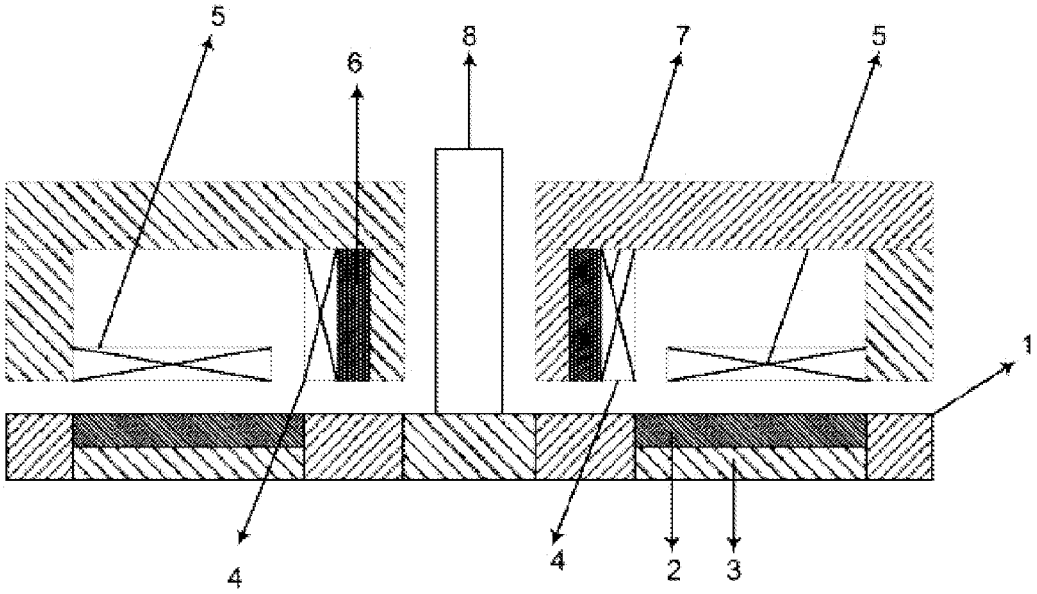
FIG. 1 is a structural schematic diagram of an embodiment of the present invention, which is used for illustrating the basic working principle of the present invention.
Figure 2:
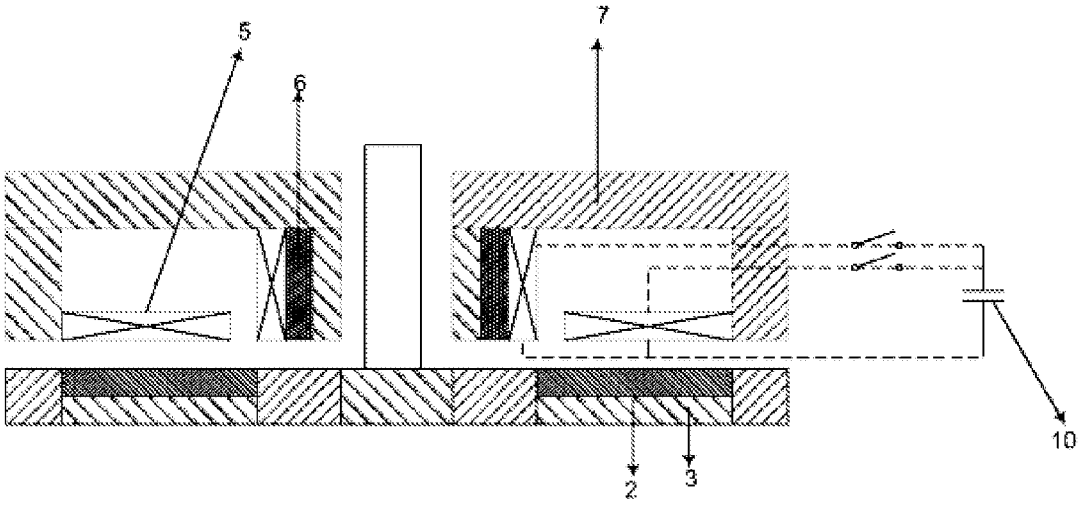
FIG. 2 is a structural schematic diagram of an electrical control circuit of an embodiment of the present invention.

The basic working principle of an embodiment of the present invention is explained in conjunction with FIGS. 1 and 2. FIG. 1 is a structural schematic diagram for illustrating the basic working principle of an embodiment of the present invention; and FIG. 2 is a structural schematic diagram of an electrical control circuit of an embodiment of the present invention.

As shown in FIG. 1, the actuator comprises the movable unit 1, just as its name implies, the movable unit 1 is movable, and here is movable between two positions, for example, a switching-off position and a switching-on position of the circuit breaker, so that the on-off operations of a circuit breaker or a high-speed reversing switch can be realized. The movable unit 1 comprises an eddy-current component 2 and a first magnet yoke component 3, which are formed integrally. The eddy-current component 2 is a disc-shaped component made of metal such as copper. It shall be noted that the eddy-current component 2 and the first magnet yoke component 3 being "formed integrally" does not mean that the eddy-current component 2 and the first magnet yoke component 3 must be made into one component, as long as the two are not separated in space and can move together under the effect of a force by virtue of interaction without the transmission of other components.

For example, the eddy-current component 2 and the first magnet yoke component 3 may be strip-shaped or plate-shaped components which are stacked in a vertical direction, and the eddy-current component and the first magnet yoke component can be fixed together by utilizing components such as a bolt or an adhesive material. Possibly, as shown in FIG. 1, the first magnet yoke component 3 may be groove-shaped, and the eddy-current component 2 may be in a strip shape which can be embedded into a groove of the first magnet yoke component 3. The eddy-current component 2 and the first magnet yoke component 3 can together form a truncated cone or a cone, so that when the mechanical strength of the moving unit 1 is maintained, the weight of the movable unit 1 can be reduced, and the air resistance against the movable unit 1 during moving can be reduced. The eddy-current component 2 and the first magnet yoke component 3 are made as a whole, so that compared with the existing actuators, this actuator is small in size and compact in structure; meanwhile, this actuator has fewer components, so that the reliability thereof is better.

The actuator shown in FIG. 1 further comprises an eddy-current coil 5 arranged opposite to the eddy-current component 2. One end of the eddy-current coil 5 is connected to a power supply capacitor or a power supply. The power supply capacitor or the power supply can be connected to a control device, so that the power supply capacitor or the power supply is controlled by the control device to charge the eddy-current coil 5, a high-frequency current and magnetic field will be generated in the eddy-current coil 5, under the action of the high-frequency magnetic field, an eddy current in the opposite direction of the current in the eddy-current coil 5 can be induced in the eddy-current component 2, a magnetic field generated by the current in the eddy-current coil 5 and a magnetic field generated by the eddy current in the eddy-current component 2 are opposite in direction, the eddy-current coil and the eddy-current interact with each other to generate a repulsive electromagnetic force, and the electromagnetic force moves the movable unit 1 quickly to execute the on or off operation. Since the eddy-current coil 5 has a small inductance, the current passing through the energized eddy-current coil 5 can be rapidly increased, and the energized eddy-current coil 5 can rapidly excite the eddy current in the eddy-current component 2, so as to generate the electromagnetic repulsive force, so that the movable unit 1 leaves the second magnet yoke component 7, and the on and off operation can be rapidly realized.

As shown in FIG. 1, the actuator further comprises a second magnet yoke component 7, and the second magnet yoke component 7 and the first magnet yoke component 3 form a magnetic circuit. As shown in FIG. 1, the first magnet yoke component 3 and the second magnet yoke component 7 can form a square framework. In addition, it shall be noted that the first magnet yoke component 3 and the second magnet yoke component 7 refer to components which are made of a magnet yoke material. The magnet yoke material refers to a soft magnetic material which does not generate a magnetic field itself and only plays a role of transmitting magnetic lines in a magnetic circuit. Magnet yoke is generally made of a soft iron with a higher magnetic permeability, A3 steel, a soft magnetic alloy, etc.

The actuator further comprises a permanent magnetic holding component 6, and the holding component is used for holding the movable unit 1 in the first position (for example, the switching-off position of the circuit breaker) or the second position (for example, the switching-on position of the circuit breaker).

The holding component can be the permanent magnet shown in FIG. 1, the permanent magnetic holding component 6 provides a holding force in both the first position and the second position, namely, when the position of the movable unit 1 is to be changed, the permanent magnetic holding component 6 always applies a resistance to the movable unit.

The actuator further comprises an electromagnetic coil 4. The electromagnetic coil 4 can be connected to the power supply capacitor or the power supply, the electromagnetic coil can excite the magnetic field under the effect of the exciting current, and the magnetic lines of the magnetic field penetrate the magnetic circuit formed by the first magnet yoke component 3 and the second magnet yoke component 7. By selecting and controlling the direction of the current flowing through the electromagnetic coil 4, the direction of the magnetic lines of the exciting magnetic field is opposite to the direction of the magnetic lines generated by the permanent magnetic holding component 6, such that the magnetic force generated by the exciting magnetic field of the electromagnetic coil 4 can counteract the magnetic field of the permanent magnetic holding component 6, and the movable unit 1 can be assisted to realize the switching-off (or switching-on) operation.

A straight-line current can be introduced into the electromagnetic coil 4, for the electromagnetic coil 4 shown in FIG. 1, for example, the straight-line current perpendicular to the paper surface and facing inwards can be loaded onto the left-hand part of the electromagnetic coil 4, and the direction of the straight-line current on the right-hand part of the electromagnetic coil 4 may be perpendicular to the paper surface and face outwards. In this case, the electromagnetic coil 4 is preferably arranged in an area (as shown in FIG. 1) in the square framework formed by the first magnet yoke component 3 and the second magnet yoke component 7, and thus the magnetic lines generated by the straight-line current can penetrate the square magnetic circuit.

In addition, an annular current further can also be introduced into the electromagnetic coil 4, and in this case, what is shown in FIG. 1 may be two individual electromagnetic coils 4 rather than a left part and a right part of one electromagnetic coil. Each electromagnetic coil 4 can be provided as one section of the square framework (i.e. the electromagnetic coil 4 being part of the magnetic circuit), such that the magnetic lines generated in the two electromagnetic coils 4 can respectively penetrate the first magnet yoke 3 on the left side and the second magnet yoke 7 on the right side of the FIG. 1. The above-mentioned form of the electromagnetic coil 4 and direction of the introduced current are exemplary, a person skilled in the art can design the forms of the current and electromagnetic coil 4 suitable for an embodiment of the present invention according to the right-hand screw rule, and there is no need to list all forms one by one herein.

Preferably, the electromagnetic coil 4 and the eddy-current coil 5 of one actuator are both located in the framework formed by the first magnet yoke component 3 and the second magnet yoke component 7 (as shown in FIG. 1), and thus the actuator has a smaller size and a more compact structure.

As shown in FIG. 2, when the electromagnetic coil 4 and the eddy-current coil 5 are both located in the framework formed by the first magnet yoke component 3 and the second magnet yoke component 7, the electromagnetic coil and the eddy-current coil share one shell (i.e. the framework formed by the first magnet yoke component 3 and the second magnet yoke component 7), so that the electromagnetic coil 4 and the eddy-current coil 5 can share one power supply or one power supply capacitor 10. Therefore, the structure of the actuator is more compact. Of course, the electromagnetic coil 4 and the eddy-current coil 5 can also each utilize an individual power supply or power supply capacitor 10.

Figure 3:
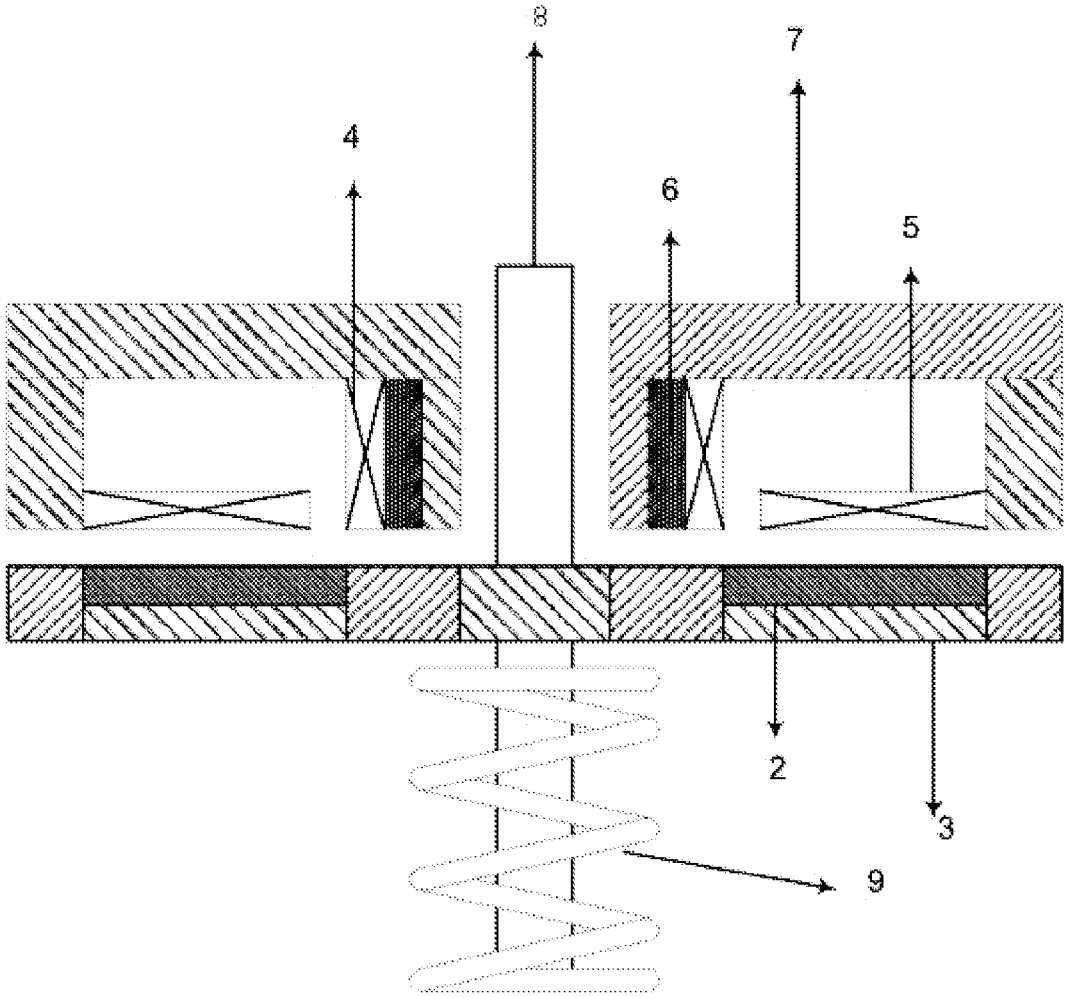
FIG. 3 is a structural schematic diagram of one embodiment of the present invention.

The working principle of the actuator of the present invention is illustrated hereinabove. Two particular applications of the actuator in the circuit breaker are illustrated hereinbelow in conjunction with FIGS. 3-5. FIG. 3 shows the structure of one embodiment of the present invention. This embodiment comprises a group of actuators shown in FIG. 1, which is used for realizing the rapid switching-off (or rapid switching-on) operation of the circuit breaker. This embodiment further comprises a drive rod 8, the drive rod 8 is connected to the movable unit 1, for example, the drive rod 8 may be connected to the first magnet yoke 3, so that the drive rod 8 can move along with the movable unit 1.

One end of the drive rod 8 is connected to a contact terminal of the circuit breaker, and the drive rod 8 moves the contact terminal so as to realize the switching-off and switching-on operations of the circuit breaker. The other end of the drive rod 8 is further connected to a spring 9, the spring 9 can provide a motive power for the downward movement of the movable unit 1 and is used for realizing the other operation which cannot be actuated by the actuator, which is the switching-off action if following the above-mentioned description.

The inductance of the eddy-current coil 5 is relatively small, the current passing through the electrified eddy-current coil 5 can be rapidly increased, the electrified eddy-current coil 5 can rapidly generate the electromagnetic repulsive force to move the movable unit 1, and the action speed of the spring 9 is much slower than that of the above-mentioned actuator, so that the embodiment shown in FIG. 3 is only suitable for the occasion where only one action of the switching-off operation and the switching-on operation needs to be fast. When the switching-off operation is required, the power supply or the power supply capacitor 10 supplies an instantaneous pulse current to the eddy-current coil 5 and generates a magnetic field, and the magnetic field generates the electromagnetic repulsive force to the eddy-current component 2, so that the movable unit 1 can rapidly leave the second magnet yoke component 7.

Meanwhile, the power supply or the power supply capacitor further can be used for powering the electromagnetic coil 4, such that the electromagnetic coil 4 generates a magnetic field, the magnetic lines of the magnetic field penetrate the magnetic circuit formed by the first magnet yoke component 3 and the second magnet yoke component 7, thereby counteracting the magnet lines of the permanent magnetic holding component 6, so that the repulsive force to the eddy-current coil 5 is reduced, and the eddy-current coil 5 can be assisted to implement the switching-off operation. When the movable unit 1 leaves the second magnet yoke 7 by a certain gap, the pulse current in the eddy-current coil 5 needs to be increased, and a large enough electromagnetic repulsive force can be generated to continuously push the movable unit 1 downwards to reach the switching-off position. The spring 9 produces a holding force to enable the movable unit 1 to be maintained in the switching-off state. When the switching-on operation is required, the power supply or the power supply capacitor 10 is controlled to charge the electromagnetic coil 4, the magnetic field generated by the charging can produce a large-enough attractive force to the movable unit 1, the attractive force can counteract the holding force produced by the switching-off spring 9, and the movable unit 1 moves to the switching-on position.

Figure 4:
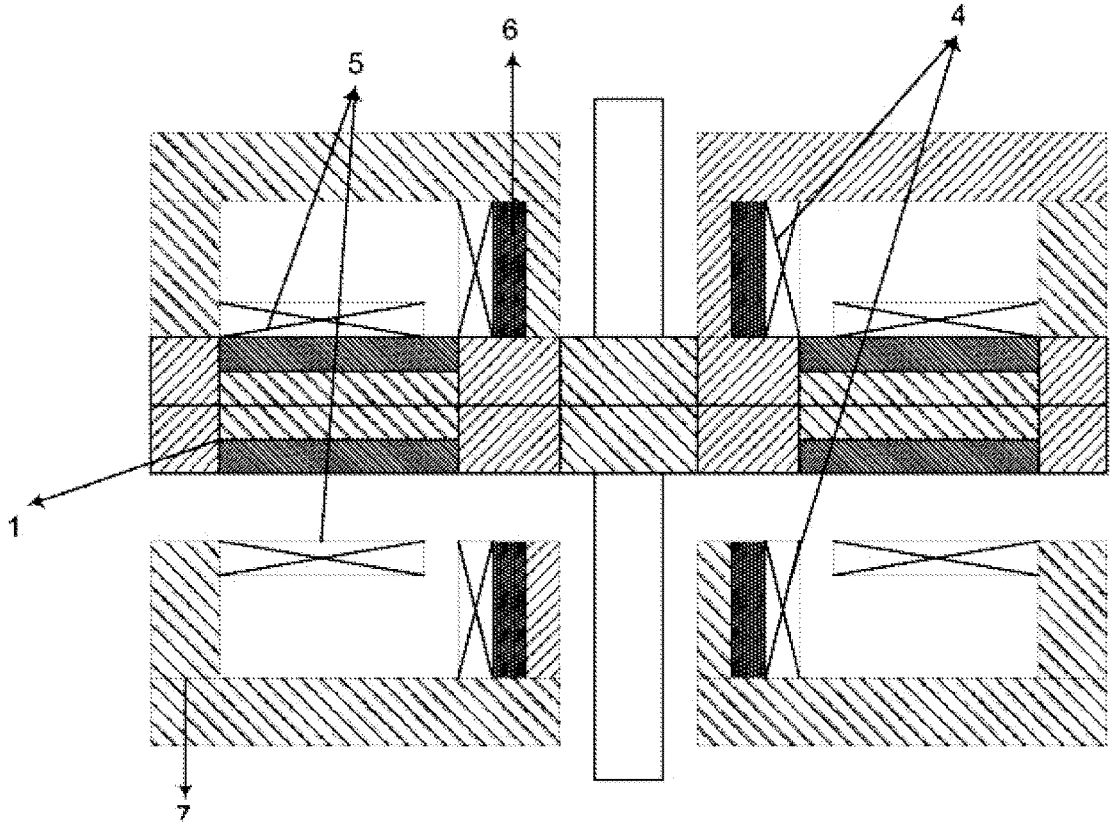
FIGS. 4 and 5 are structural schematic diagrams of another embodiment of the present invention, which can be applied to a circuit breaker and comprises two groups of actuators.
Figure 5:
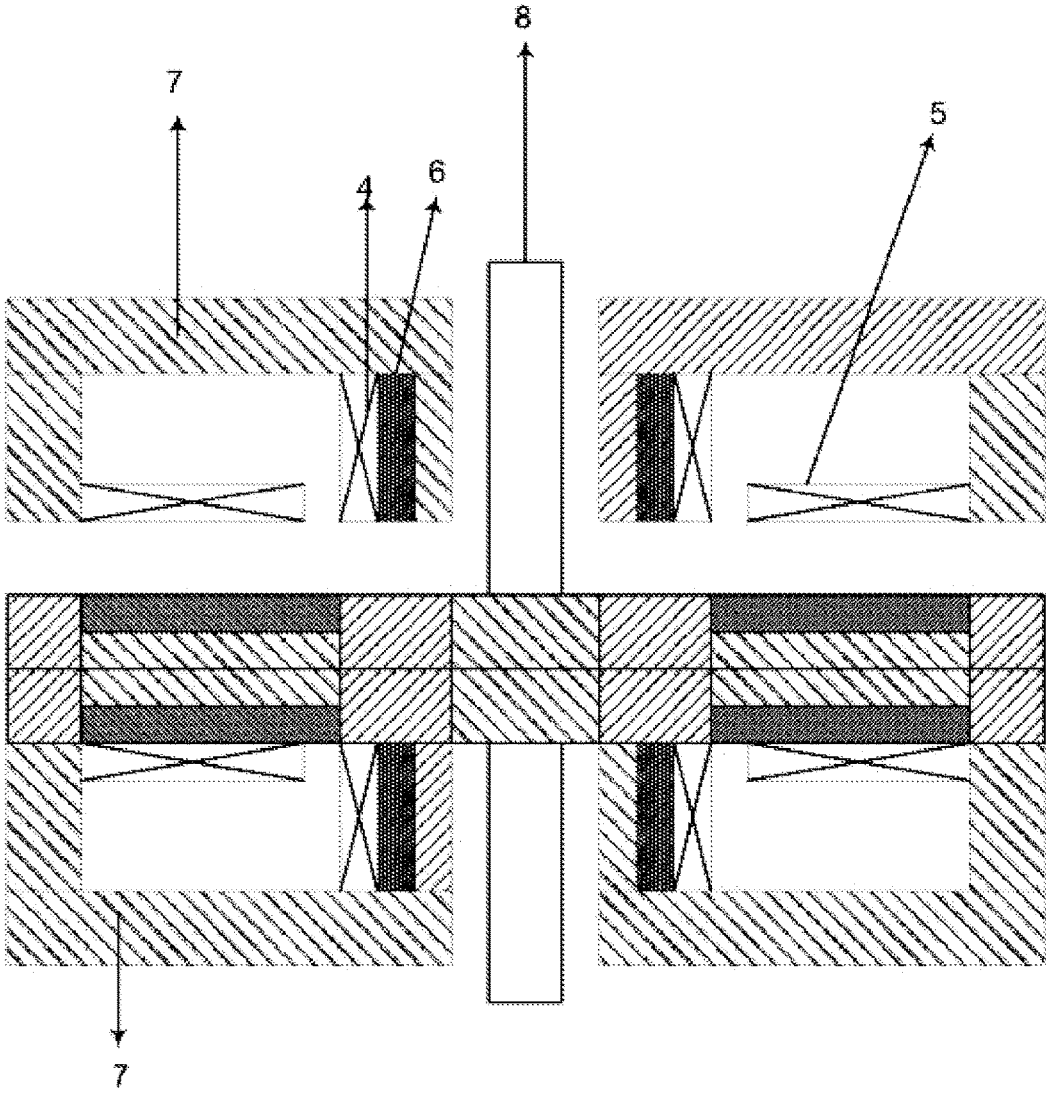

FIGS. 4 and 5 are structural schematic diagrams of another embodiment of the present invention, this embodiment comprises two groups of actuators shown in FIG. 3, and the two groups of actuators are symmetrically arranged relative to the drive rod 8. FIG. 4 shows one state of the embodiment, and FIG. 5 shows another state of the embodiment.

It assumes that FIG. 4 shows the switching-on state of the circuit breaker, and FIG. 5 shows the switching-off state of the circuit breaker (actually, vice versa, i.e. FIG. 4 shows the switching-off state, and FIG. 5 shows the switching-on state), so as to describe the switching-off and switching-on process of the embodiment.

When the switching-off operation is required, as shown in FIG. 5, the upper eddy-current coil 5 is energized to produce a downward electromagnetic repulsive force to the eddy-current component 2. Meanwhile, the upper electromagnetic coil is energized to generate the magnetic field, and the direction of the magnetic lines of the magnetic field is opposite to the direction of the magnetic lines of the permanent magnet which is used as the holding component 6, so that the magnet lines of the permanent magnetic holding component 6 can be counteracted.

In addition, the current in an appropriate direction may be loaded onto the lower electromagnetic coil 4, so that the lower electromagnetic coil 4 produces the attractive force to the movable unit 1, and the eddy-current coil 2 is assisted to move the movable unit 1 downwards to reach the switching-off position. Possibly, after the eddy-current component 2 leaves the second magnet yoke component 7 by a certain gap, the current in an appropriate direction and size is loaded onto the lower electromagnetic coil 4 in FIGS. 4 and 5, the power supply is controlled to stop the charging of the eddy-current coil 5, the lower electromagnetic coil 4 produces the large-enough attractive force to the movable unit 1, and the movable unit 1 is driven to continuously move downwards to reach the switching-off position.

After the movable unit 1 (including the eddy-current component 2) leaves the second magnet yoke component 7 by a certain gap, if the current of a size identical to that at the beginning of the switching-off operation is still loaded onto the eddy-current coil 5, the eddy current generated in the eddy-current component 2 can be greatly reduced due to the existence of a gap between the first magnet yoke component 3 and the second magnet yoke component 7, namely, the electromagnetic repulsive force applied by the eddy-current coil 5 on the movable unit 1 can be greatly reduced. Now, if the electromagnetic repulsive force needs to be maintained constant, the current in the eddy-current coil 5 needs to be greatly increased.

For example, when the distance between the movable unit 1 and the second magnet yoke component 7 is 1 mm, the large-enough electromagnetic repulsive force can be generated by loading a current of 100 A onto the eddy-current coil 5, when the distance between the movable unit 1 and the second magnet yoke component 7 is 3 mm, the same electromagnetic repulsive force can be generated by loading a current of 1000 A onto the eddy-current coil 5 (this example is only used for illustrating the general relationship between the gap of the movable unit 1 and the second magnet yoke component 7 and the current loaded onto the eddy-current coil 5.) In order to reduce the current required to be loaded onto the eddy-current coil 5 after the movable unit 1 is separated from the second magnet yoke component 7 by a certain gap, as mentioned above, the lower electromagnetic coil 4 in FIGS. 4 and 5 can be powered on, the lower electromagnetic coil 4 will produce a downward attractive force to the movable unit 1, and the movable unit 1 further moves downwardly to reach the switching-off position shown in FIG. 5. If there is no need to consider energy conservation, the eddy-current coil 5 can also be continuously powered to increase the current value after the movable unit 1 leaves the second magnet yoke component 7 by a certain gap, so that the large-enough electromagnetic repulsive force is generated to push the movable unit 1 downwards, and there is no need to load the current onto the lower electromagnetic coil 4.

When the switching-on operation is required, as shown in FIG. 4, the lower eddy-current coil 5 is energized, and the lower eddy-current coil 5 produces an upward electromagnetic repulsive force to the eddy-current component 2. After the movable unit 1 leaves the lower second magnet yoke component 7 by a certain gap, the power supplying for the lower eddy-current coil 5 can be stopped, and the current in an appropriate direction can be loaded onto the upper electromagnetic coil 4, such that the upper electromagnetic coil 4 produces an attractive force to the movable unit 1. Meanwhile, the current in an appropriate direction can also be loaded onto the lower electromagnetic coil 4, such that the lower electromagnetic coil 4 generates a magnetic field, and ensures that the direction of magnetic lines of the magnetic field is opposite to the direction of the magnetic lines of the permanent magnetic holding component 6, so as to counteract the magnetic lines of the permanent magnetic holding component 6.

The upper electromagnetic coil 4 and the lower electromagnetic coil 4 can together assist the lower eddy-current component 6 to continuously move the movable unit 1 upwardly to reach the switching-on position. The current in the appropriate direction further can be loaded onto the upper electromagnetic coil 4 and the lower electromagnetic coil 4 at the beginning of the switching-on operation, and the eddy-current coil 5 is assisted to move the movable unit 1 upwardly. Possibly, only the lower eddy-current coil 5 is energized. After the movable unit 1 leaves the lower second magnet yoke component 7 by a certain gap, the current value in the lower eddy-current coil 5 is increased, such that the lower eddy-current coil produces a large-enough electromagnetic repulsive force so as to continuously push the movable unit 1 upwardly, and the current is not loaded onto the two electromagnetic coils 4.

Therefore, the upper electromagnetic coil 4 and the lower electromagnetic coil 4 in the upper and the lower groups of actuators in FIGS. 4 and 5 have different functions. When in the switching-off operation, the upper electromagnetic coil 4 only can generate the magnetic field to counteract the magnetic lines of the permanent magnetic holding component 6 and cannot produce the repulsive force to the movable unit 1, and the lower electromagnetic coil 4 can produce the downward attractive force to the movable unit 1. When in the switching-on operation, the lower electromagnetic coil 4 only can generate the magnetic field to counteract the magnetic lines of the permanent magnetic holding component 6, and the upper electromagnetic coil 4 can produce the upward attractive force to the movable unit 1. If the energy-saving factor is not considered, either the switching-off operation or the switching-on operation can be realized by only powering the eddy-current coil 5.

The above-mentioned embodiment shown in FIGS. 4 and 5 is provided with two groups of actuators, so that not only rapid switching-off operation can be realized, but also rapid switching-on operation can be realized. The switching-off speed and the switching-on speed are both very high, and the average action time can reach 5 m/s. In the occasion where the circuit needs to be rapidly protected and the circuit needs to rapidly return to work, this embodiment can be utilized.

It can be seen from the above that according to the embodiment of the present invention, the eddy-current component 2 and the first magnet yoke component 3 are made as a whole, so that compared with the existing actuators, this actuator is small in size and compact in structure; meanwhile, this actuator has fewer components, so that the reliability thereof is better, and the control mode is more flexible. In addition, due to the compact structure, a plurality of circuit breakers with such an actuator can be connected in series in a high-voltage application. For example, if the rated voltage of a circuit breaker with the actuator is 20 KV, and the rated voltage of a power transmission line is 50 KV, then three circuit breakers of this type can be connected in series to protect the power transmission line.

In addition, by utilizing the eddy-current coil 5, the switching-off and/or switching-on operation can be rapidly realized. This is because the eddy-current coil 5 has a small inductance, the current passing through the energized eddy-current coil 5 can be rapidly increased, and the energized eddy-current coil 5 can rapidly excite the eddy current in the eddy-current component 2, so as to generate the electromagnetic repulsive force to make the movable unit 1 leave the second magnet yoke component 7. Meanwhile, the electromagnetic coil 4 can also assist the eddy-current coil 5 to complete the switching-off operation. The current in the appropriate direction can be introduced into the electromagnetic coil 4, the magnetic field excited by the electromagnetic coil 4 and the magnetic field of the permanent magnet are opposite in direction, thus the magnetic lines of the magnetic field of the permanent magnet can be counteracted. By combining the eddy-current coil 5 and the electromagnetic coil 4 in FIGS. 4 and 5, the current value loaded onto the eddy-current coil 5 when the movable unit 1 is separated from the second magnet yoke 7 by a certain distance can be greatly reduced, so that the energy consumption can be greatly reduced.

The above-mentioned embodiments are preferable embodiments of the present invention and are not intended to limit the scope of protection of the present invention. Any modifications, equivalent replacements, or improvements made within the spirit and principles of the present invention should be included within the scope of protection of the present invention.

The invention claimed is:

1. A magnetic actuator, comprising:

a movable unit, movable between a first position and a second position, the movable unit including an integrally formed eddy-current component and a first magnet yoke component;

a second magnet yoke component to form a magnetic circuit with the first magnet yoke component;

an electromagnetic coil to generate an exciting magnetic field when being energized, with magnetic lines generated by the electromagnetic coil being energized penetrating the magnetic circuit formed by the second magnet yoke component and the first magnet yoke component;

an eddy-current coil arranged opposite to the eddy-current component and configured to enable an eddy current to be generated in the eddy-current component, so as to produce an electromagnetic repulsive force to the movable unit; and a permanent magnetic holding component to hold the movable unit in the first position or the second position.

2. The actuator of claim 1, wherein the first magnet yoke component is provided with a groove, and wherein the eddy-current component is located in the groove.

3. The actuator of claim 1, wherein the eddy-current component and the first magnet yoke component together form a cone or a truncated cone.

4. The actuator claim 1, wherein the electromagnetic coil and the eddy-current coil are both located in a framework formed by the eddy-current component and the first magnetic yoke component.

5. The actuator of claim 4, wherein the electromagnetic coil and the eddy-current coil share a power supply or a power supply capacitor, or each utilize an individual power supply or power supply capacitor.

6. The actuator of claim 1, wherein the actuator is used for a circuit breaker, and wherein the actuator further comprises a drive rod, the drive rod is connected to the movable unit and one end of the drive rod is connected to a contact terminal of the circuit breaker.

7. The actuator of claim 6, wherein the other end of the drive rod is connected to a spring, the spring being used to hold the movable unit in either a switching-off position or a switching-on position of the circuit breaker, and wherein the permanent magnetic holding component is used to hold the circuit breaker in the other of the switching-off and switching-on positions.

8. The actuator of claim 6, wherein two groups of actuators are symmetrically arranged relative to the drive rod.

9. The actuator of claim 2, wherein the eddy-current component and the first magnet yoke component together form a cone or a truncated cone.

10. The actuator of claim 2, wherein the electromagnetic coil and the eddy-current coil are both located in a framework formed by the eddy-current component and the first magnetic yoke component.

11. The actuator of claim 10, wherein the electromagnetic coil and the eddy-current coil share a power supply or a power supply capacitor, or each utilize an individual power supply or power supply capacitor.

12. The actuator of claim 2, wherein the actuator is used for a circuit breaker, and wherein the actuator further comprises a drive rod, the drive rod is connected to the movable unit and one end of the drive rod is connected to a contact terminal of the circuit breaker.

13. The actuator of claim 12, wherein the other end of the drive rod is connected to a spring, the spring being used to hold the movable unit in either a switching-off position or a switching-on position of the circuit breaker, and wherein the permanent magnetic holding component is used to hold the circuit breaker in the other of the switching-off and switching-on positions.

14. The actuator of claim 7, wherein two groups of actuators are symmetrically arranged relative to the drive rod.

15. A circuit breaker, comprising:

the actuator of claim 1, wherein the actuator further comprises a drive rod, the drive rod being connected to the movable unit and one end of the drive rod is connected to a contact terminal of the circuit breaker.

16. The circuit of claim 15, wherein the other end of the drive rod is connected to a spring, the spring being used to hold the movable unit in either a switching-off position or a switching-on position of the circuit breaker, and wherein the permanent magnetic holding component is used to hold the circuit breaker in the other of the switching-off and switching-on positions.

17. The circuit of claim 15, wherein the circuit breaker includes a plurality of the actuators, symmetrically arranged relative to the drive rod.

18. The circuit of claim 16, wherein the circuit breaker includes a plurality of the actuators, symmetrically arranged relative to the drive rod.

* * * * *